US009956771B2

(12) United States Patent
Maxfield

(10) Patent No.: US 9,956,771 B2
(45) **Date of Patent: *May 1, 2018**

(54) FLUID EJECTION APPARATUS WITH SINGLE-SIDE THERMAL SENSOR

(71) Applicant: HEWLETT-PACKARD DEVELOPMENT COMPANY, L.P., Houston, TX (US)

(72) Inventor: David Maxfield, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/705,608

(22) Filed: Sep. 15, 2017

(65) Prior Publication Data

US 2018/0001628 A1 Jan. 4, 2018

Related U.S. Application Data

(63) Continuation of application No. 15/486,602, filed on Apr. 13, 2017, now Pat. No. 9,796,178, which is a continuation of application No. 15/039,259, filed as application No. PCT/US2013/072084 on Nov. 26, 2013, now Pat. No. 9,669,624.

(51) Int. Cl.
*B41J 2/045* (2006.01)

(52) U.S. Cl.
CPC ..... *B41J 2/04563* (2013.01); *B41J 2/04586* (2013.01)

(58) Field of Classification Search
CPC . B41J 2/14153; B41J 2/04586; B41J 2/04563
See application file for complete search history.

(56) References Cited

U.S. PATENT DOCUMENTS

| | | | |
|---|---|---|---|
| 6,382,773 | B1 | 5/2002 | Chang et al. |
| 6,860,590 | B2 | 3/2005 | Silverbrook |
| 7,086,142 | B2 | 8/2006 | Kim et al. |
| 7,350,902 | B2 | 4/2008 | Dietl |
| 7,828,419 | B2 | 11/2010 | Ikegame et al. |
| 8,118,406 | B2 | 2/2012 | Ciminelli |
| 9,669,624 | B2 * | 6/2017 | Maxfield ..... B41J 2/14153 |

(Continued)

FOREIGN PATENT DOCUMENTS

| | | |
|---|---|---|
| CN | 101332700 | 12/2008 |
| JP | 1990-289354 | 11/1990 |

(Continued)

OTHER PUBLICATIONS

Cheng, C.Y. et al; "A Monolithic Thermal Inkjet Printhead Combining Anisotropic Etching and Electro Plating"; Jul. 2000; https://www.google.co.in/url?sa=t&rct=j&q=&esrc=s&source=web&cd=1&cad=rja&ved=OCEAQFjAA&url=http%3A%2F%2Fwww.dtic.mil%2Fcgi-bin%2FGetTRDoc%3FAD%3DADP011361&ei=30FSUuvUJcKErAemklF4&usg=AFQjCNF-gBV3GucuQ5XgSSW26Kzwm-5Vbg&sig2=GVIz6NNxLXqmogm85OIBJA&bvm=bv.53537100,d.bmk.

*Primary Examiner* — Lamson Nguyen
(74) *Attorney, Agent, or Firm* — Fabian VanCott

(57) ABSTRACT

An example provides a fluid ejection apparatus including a fluid feed slot to supply a fluid to a plurality of drop ejectors, a first rib at a first side of the fluid feed slot and supporting drop ejection circuitry to control ejection of drops of the fluid from the plurality of drop ejectors, and a second rib at a second side, opposite the first side, of the fluid feed slot supporting a thermal sensor to facilitate determination of a temperature of the first rib and the second rib.

20 Claims, 5 Drawing Sheets

(56) References Cited

U.S. PATENT DOCUMENTS

| | | | | |
|---|---|---|---|---|
| 9,796,178 | B2 * | 10/2017 | Maxfield | B41J 2/04586 |
| 2005/0275676 | A1 | 12/2005 | Parish | |
| 2006/0006681 | A1 | 1/2006 | Newbill | |
| 2009/0002425 | A1 | 1/2009 | Min | |
| 2009/0058914 | A1 | 3/2009 | Kim et al. | |
| 2009/0174753 | A1 | 7/2009 | Kurokawa | |
| 2009/0309913 | A1 | 12/2009 | Oohashi | |
| 2013/0155142 | A1 | 6/2013 | Browning et al. | |

FOREIGN PATENT DOCUMENTS

| | | | |
|---|---|---|---|
| JP | 2001-191515 | | 7/2001 |
| JP | 2009-061771 | | 3/2009 |
| JP | 2009-066861 | | 4/2009 |
| JP | 2011-167963 | | 9/2011 |
| JP | 2013-163367 | | 8/2013 |
| KR | 10-2005-0073093 | A | 7/2005 |
| KR | 10-2010-0004787 | A | 1/2010 |
| TW | 200615151 | | 5/2006 |
| WO | WO-2006/105570 | A1 | 10/2006 |

* cited by examiner

FLUID EJECTION APPARATUS WITH SINGLE-SIDE THERMAL SENSOR

BACKGROUND

Some inkjet printing systems and replaceable printer components, such as some inkjet printhead assemblies, may include a thermal sensor to allow a printer to determine the temperature of the printhead assembly. During operation, the printing system may monitor the thermal sensor and control operation of the printing system based on detected temperatures. For example, the printing system may halt or modulate printing in the event the printhead assembly is overheated or may heat a printhead assembly that is below a desired operating temperature.

BRIEF DESCRIPTION OF THE DRAWINGS

The Detailed Description section references, by way of example, the accompanying drawings, all in which various embodiments may be implemented.

Figure 1:
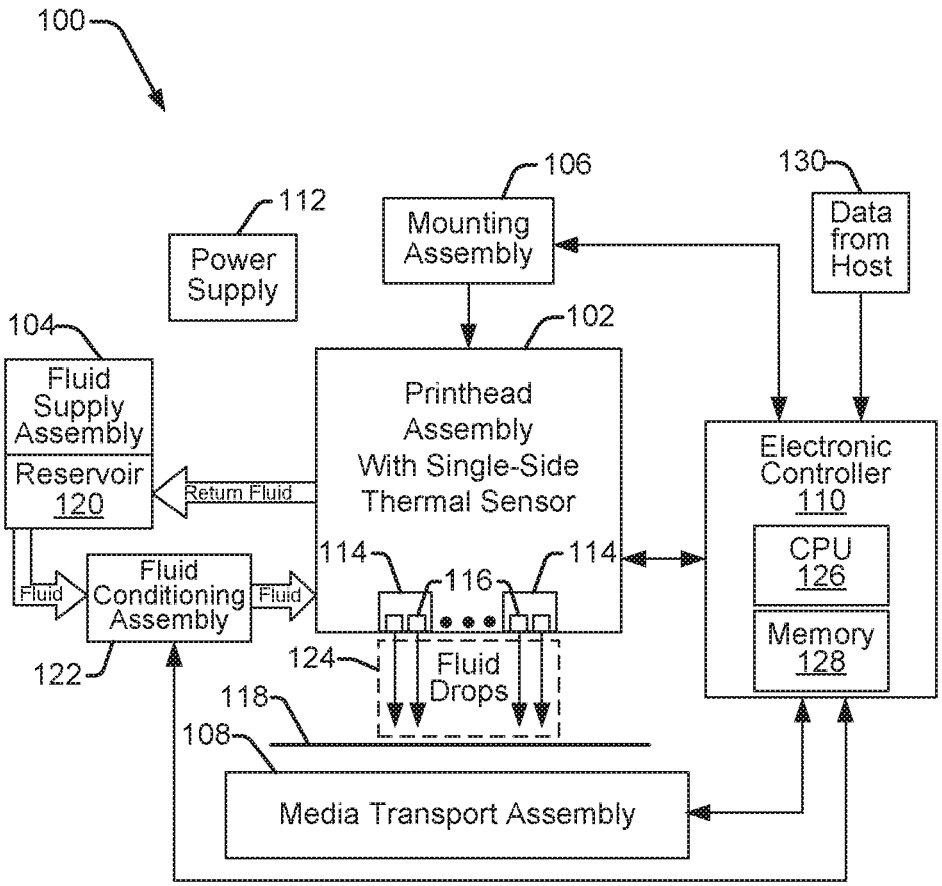
FIG. 1 is a block diagram of an example fluid ejection system.

Certain examples are shown in the above-identified drawings and described in detail below. The drawings are not necessarily to scale, and various features and views of the drawings may be shown exaggerated in scale or in schematic for clarity and/or conciseness.

DETAILED DESCRIPTION

Device features continue to decrease in size. Printheads, for instance, may realize improved print quality as the number of nozzles increase. Devices that incorporate micro-and-smaller-electrical-mechanical-systems (generally referred to herein as "MEMS") devices, by definition, are very small and continue to serve a broad range of applications in a broad range of industries.

Fabrication of small device features cost-effectively and with high performance and reliability, however, may be a challenge. Continuing with the printhead example, an increased number of nozzles and/or decreased printhead size. For some inkjet printheads, a primary geometric tuning parameter for cost may be the width of the printhead die as the length of the die may be fixed for various reasons. The width of the printhead die, however, may be limited by bond pads, control circuits, and fluidic routing, but when these constraints have been addressed a remaining constraint may be the width needed for mounting the die to the rest of the printhead.

For a printhead die with a single fluid feed slot, the narrowness of the die may inhibit locating the control circuits on the end of the die, and so the circuits may instead by located on one of the two ribs straddling the fluid feed slot. In this latter configuration, however, the fluid feed slot may be pushed off-center such that one of the ribs is narrower than the other one of the ribs. In some cases, the narrowness of the narrower rib may be constrained by a mechanical strength required to avoid fracture when subjected to the stress and strain of the assembly process, temperature changes, and mechanical shock. In addition, a minimum area may be required to obtain a seal to the rest of the printhead to prevent ink from escaping during pressure transients and prevent air from being drawn into the cartridge due to the negative backpressure that is maintained to keep the ink in the cartridge until action of the printhead ejects a drop.

For some printhead assemblies including temperature monitoring, performance may be enhanced by measuring die temperature across the length of the plurality of nozzles, which may run along the length of the ink feed slot, and in some cases, performance requirements may preclude the use of a small number of point sensors for detecting temperature. Some printhead assemblies may include a thermal sense resistor (TSR) routing on both ribs of a single-slot die to monitor temperature across the printhead. In some of these configurations, the TSR may sense the temperature along the length of the plurality of nozzles and the thermal measurements may be averaged along the length of the plurality of nozzles by the geometry of the TSR. Routing a TSR on both ribs, however, may result in a high delta in the widths of the ribs. For example, one narrower rib may include a TSR and the other wider rib may include control circuitry and a TSR.

Described herein are various implementations of a fluid ejection apparatus configured to monitor printhead die temperature from a single side of a fluid feed slot of a printhead die. In various implementations, the fluid ejection apparatus may include a fluid feed slot to supply a fluid to a plurality of drop ejectors, a first rib at a first side of the fluid feed slot and supporting drop ejection circuitry to control ejection of drops of the fluid from the plurality of drop ejectors, and a second rib at a second side, opposite the first side, of the fluid feed slot and supporting a thermal sensor to facilitate determination of a temperature of the first rib. In various ones of these implementations, the first rib is devoid of thermal sensors. In various implementations, the first rib is wider than the second rib but the delta of the widths of the ribs may be smaller than for configurations in which a thermal sensor is disposed on the first rib along with drop ejection circuitry. In various implementations, the fluid ejection apparatus may include a controller to determine a temperature of the first rib based at least in part on a temperature detected at the second rib by the thermal sensor and control operation of the printhead based at least in part on the determined temperature.

FIG. 1 illustrates an example fluid ejection system 100 suitable for incorporating a fluid ejection apparatus comprising a single-side thermal sensor as described herein. In various implementations, the fluid ejection system 100 may comprise an inkjet printing system. The fluid ejection system 100 may include a printhead assembly 102, a fluid supply assembly 104, a mounting assembly 106, a media transport assembly 108, an electronic controller 110, and at least one power supply 112 that may provide power to the various electrical components of fluid ejection system 100.

The printhead assembly 102 may include at least one printhead 114 comprising a substrate having a first rib having drop ejection circuitry to control ejection of drops from a plurality of drop ejectors 116, such as orifices or nozzles, for example, and a second rib having a thermal sensor, and a fluid feed slot disposed between the first rib and the second rib to supply fluid to the plurality of drop ejectors 116, as described more fully herein. The plurality of drop ejectors 116 may eject ejects drops of fluid such as ink, for example, toward a print media 118 so as to print onto the print media 118. The print media 118 may be any type of suitable sheet or roll material, such as, for example, paper, card stock, transparencies, polyester, plywood, foam board, fabric, canvas, and the like. The drop ejectors 116 may be arranged in one or more columns or arrays such that properly sequenced ejection of fluid from drop ejectors 116 may cause characters, symbols, and/or other graphics or images to be printed on the print media 118 as the printhead assembly 102 and print media 118 are moved relative to each other.

The fluid supply assembly 104 may supply fluid to the printhead assembly 102 and may include a reservoir 120 for storing the fluid. In general, fluid may flow from the reservoir 120 to the printhead assembly 102, and the fluid supply assembly 104 and the printhead assembly 102 may form a one-way fluid delivery system or a recirculating fluid delivery system. In a one-way fluid delivery system, substantially all of the fluid supplied to the printhead assembly 102 may be consumed during printing. In a recirculating fluid delivery system, however, only a portion of the fluid supplied to the printhead assembly 102 may be consumed during printing. Fluid not consumed during printing may be returned to the fluid supply assembly 104. The reservoir 120 of the fluid supply assembly 104 may be removed, replaced, and/or refilled.

In some implementations, the fluid supply assembly 104 may supply fluid under positive pressure through a fluid conditioning assembly 122 to the printhead assembly 102 via an interface connection, such as a supply tube. Conditioning in the fluid conditioning assembly 122 may include filtering, pre-heating, pressure surge absorption, and degassing. Fluid may be drawn under negative pressure from the printhead assembly 102 to the fluid supply assembly 104. The pressure difference between the inlet and outlet to the printhead assembly 102 may be selected to achieve the correct backpressure at the drop ejectors 116, and may typically be a negative pressure between negative 1" and negative 10" of $H_2O$.

The mounting assembly 106 may position the printhead assembly 102 relative to the media transport assembly 108, and the media transport assembly 108 may position the print media 118 relative to the printhead assembly 102. In this configuration, a print zone 124 may be defined adjacent to the drop ejectors 116 in an area between the printhead assembly 102 and print media 118. In some implementations, the printhead assembly 102 is a scanning type printhead assembly. As such, the mounting assembly 106 may include a carriage for moving the printhead assembly 102 relative to the media transport assembly 108 to scan the print media 118. In other implementations, the printhead assembly 102 is a non-scanning type printhead assembly. As such, the mounting assembly 106 may fix the printhead assembly 102 at a prescribed position relative to the media transport assembly 108. Thus, the media transport assembly 108 may position the print media 118 relative to the printhead assembly 102.

The electronic controller 110 may include a processor (CPU) 126, memory 128, firmware, software, and other electronics for communicating with and controlling the printhead assembly 102, mounting assembly 106, and media transport assembly 108. Memory 128 may include both volatile (e.g., RAM) and nonvolatile (e.g., ROM, hard disk, floppy disk, CD-ROM, etc.) memory components comprising computer/processor-readable media that provide for the storage of computer/processor-executable coded instructions, data structures, program modules, and other data for the printing system 100. The electronic controller 110 may receive data 130 from a host system, such as a computer, and temporarily store the data 130 in memory 128. Typically, the data 130 may be sent to the printing system 100 along an electronic, infrared, optical, or other information transfer path. The data 130 may represent, for example, a document and/or file to be printed. As such, the data 130 may form a print job for the printing system 100 and may include one or more print job commands and/or command parameters.

In various implementations, the electronic controller 110 may control the printhead assembly 102 for ejection of fluid drops from the drop ejectors 116. Thus, the electronic controller 110 may define a pattern of ejected fluid drops that form characters, symbols, and/or other graphics or images on the print media 118. The pattern of ejected fluid drops may be determined by the print job commands and/or command parameters from the data 130. In various implementations, the electronic controller 110 may determine a temperature of a first rib disposed at a first side of a fluid feed slot of the printhead 114 based at least in part on a temperature detected at a second rib, at a second side opposite the first side of the fluid feed slot, of the printhead 114 by a thermal sensor and control operation of the printhead 114 based at least in part on the determined temperature.

In various implementations, the printing system 100 is a drop-on-demand thermal inkjet printing system with a thermal inkjet (TIJ) printhead 114 suitable for implementing single-side thermal sensor as described herein. In some implementations, the printhead assembly 102 may include a single TIJ printhead 114. In other implementations, the printhead assembly 102 may include a wide array of TIJ printheads 114. While the fabrication processes associated with TIJ printheads are well suited to the integration of single-side thermal sensing, other printhead types such as a piezoelectric printhead can also implement such single-side thermal sensing. Thus, the disclosed single-side thermal sensor is not limited to implementation in a TIJ printhead 114.

Figure 2:
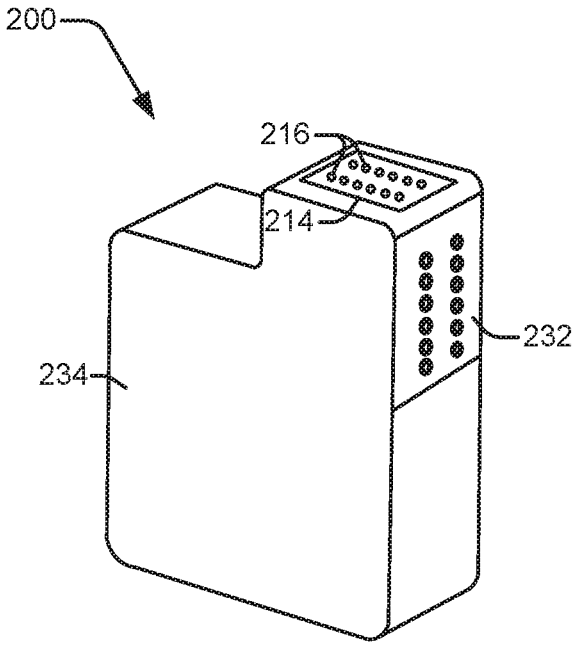
FIG. 2 is a perspective view of an example fluid ejection cartridge.

In various implementations, the printhead assembly 102, fluid supply assembly 104, and reservoir 120 may be housed together in a replaceable device such as an integrated printhead cartridge. FIG. 2 is a perspective view of an example inkjet cartridge 200 that may include the printhead assembly 102, ink supply assembly 104, and reservoir 120, according to an implementation of the disclosure. In addition to one or more printheads 214, inkjet cartridge 200 may include electrical contacts 232 and an ink (or other fluid) supply chamber 234. In some implementations, the cartridge 200 may have a supply chamber 234 that stores one color of ink, and in other implementations it may have a number of chambers 234 that each store a different color of ink. The electrical contacts 232 may carry electrical signals to and from controller (such as, for example, the electrical controller 110 described herein with reference to FIG. 1), for example, to cause the ejection of ink drops through drop ejectors 216 and single-side thermal sensing of the printhead 214.

Figure 3A:
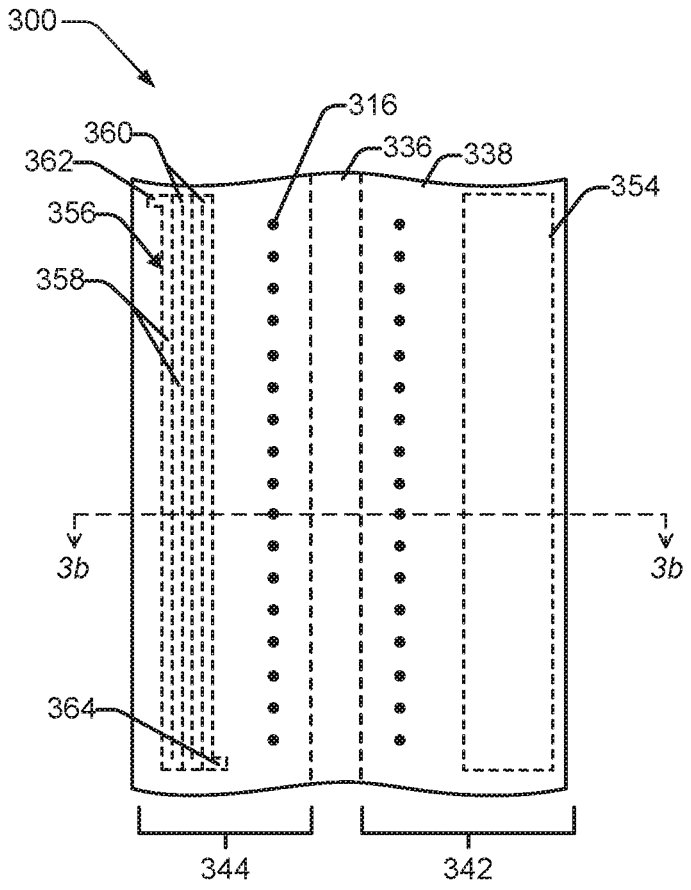
FIG. 3*a* is a top view of an example fluid ejection apparatus having a fluid feed slot and a thermal sensor on a single side of the fluid slot.
Figure 3B:
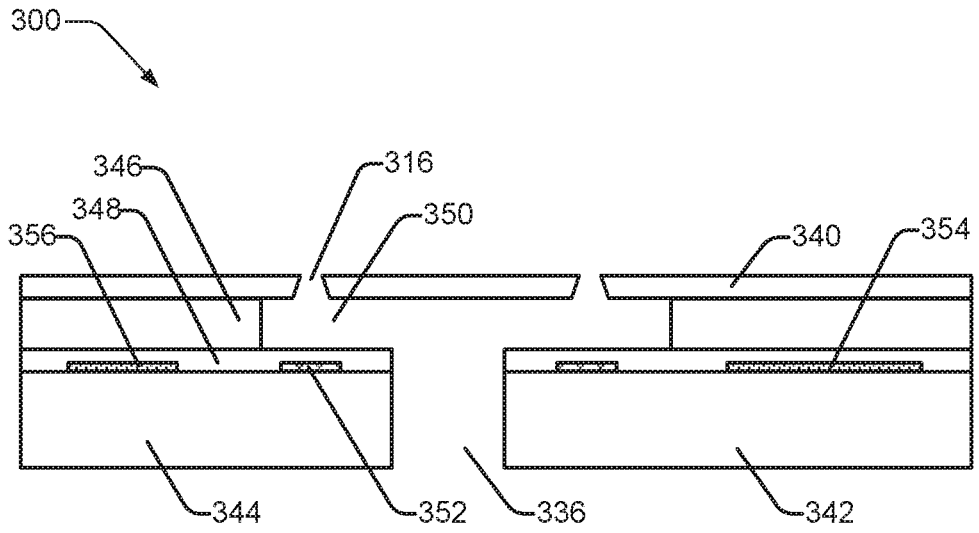
FIG. 3*b* is a sectional view of the fluid ejection apparatus of FIG. 3*a*.

FIG. 3*a* and FIG. 3*b* illustrate views of example fluid ejection apparatus 300 having a single fluid feed slot 336 formed in a printhead die/substrate 338. In various implementations, the fluid ejection apparatus 300 may comprise, at least in part, a printhead or printhead assembly. In some implementations, for example, the fluid ejection apparatus 300 may be an inkjet printhead or inkjet printing assembly.

As illustrated, the fluid ejection apparatus 300 has a single fluid feed slot 336 formed in a printhead die/substrate 338. Various components of the fluid ejection apparatus 300 include a drop ejector layer 340 including a plurality of fluid drop ejectors 316, a first rib 342 at a first side of the fluid feed slot 336, and a second rib 344 at a second side, opposite the first side, of the fluid feed slot 336 such that the fluid feed slot 336 is disposed between the first rib 342 and the second rib 344. In various implementations, the plurality of drop ejectors 316 may comprise a first plurality of drop ejectors 316 over the first rib 342 and a second plurality of drop ejectors 316 over the second rib 344. In various ones of these implementations, the plurality of drop ejectors 316 may comprise a plurality of columns of the drop ejectors 316, wherein at least one column of the drop ejectors 316 is disposed over the first rib 342 and a second column of drop ejectors 316 is disposed over the second rib 344. It is noted that although the illustrated example depicts only two columns of drop ejectors 316, many implementations may include more columns and/or columns with more or fewer drop ejectors 316 than shown.

As shown in FIG. 3*b*, the drop ejector layer 340 may be in spaced relation to the substrate 338, with a barrier layer 346 between the drop ejector layer 340 and the substrate 338. In various implementations, the fluid ejection apparatus 300 may include one or more insulating layers 348 on the substrate 338. As shown, the drop ejector layer 340, barrier layer 346, and the insulating layer 348/substrate 338 define, at least in part, a firing chamber 350. The fluid ejection apparatus 300 may further include an actuator 352 proximate to each firing chamber 350. The actuators 352 may be configured to cause fluid to be ejected through a corresponding one of the drop ejectors 316. In some implementations, the actuators 352 may comprise resistive or heating elements. In some implementations, the actuators 352 comprise split resistors or single rectangular resistors. Other types of actuators such as, for example, piezoelectric actuators or other actuators may be used for the actuators 352 in other implementations.

The fluid feed slot 336 may provide a supply of fluid to the drop ejectors 316 via the firing chambers 350. In many implementations, the fluid ejection apparatus 300 may include a plurality of firing chambers 350, each fluidically coupled to at least one of a plurality of drop ejectors 316 similar to the drop ejectors 316 illustrated, and in at least some of these implementations, the fluid feed slot 336 may provide fluid to all or most of the plurality of drop ejectors 316 via corresponding ones of the firing chambers 350.

With continued reference to FIG. 3*a* and FIG. 3*b*, the first rib 342 may support drop ejection circuitry 354 to control ejection of drops of the fluid from the plurality of drop ejectors 316 over the first rib 342 and the second rib 344, and the second rib 344 may support a thermal sensor 356. In various implementations, the thermal sensor 356 may facilitate determination of the temperature of the first rib 342 and the second rib 344 of the substrate 338 by sampling the temperature of only the second rib 344 rather than from both the first rib 342 and the second rib 344. As such, in various ones of these implementations, the first rib 342 may be devoid of thermal sensors. It is noted that the drop ejection circuitry 354 and thermal sensor 356 are shown in simplified form for illustration purposes and those skilled in the art will understand that the drop ejection circuitry 354 and/or thermal sensor 356 may take on any of variety of configurations without deviating from the scope of the present disclosure.

As illustrated, the fluid feed slot 336 is off centered in the substrate 338, such that the first rib 342 is wider than the second rib 344, due at least in part to the drop ejection circuitry 354 consuming a larger area of the substrate 338 as compared to the thermal sensor 356. In other implementations, the first rib 342 and the second rib 344 may have widths that are identical or substantially similar. In any event, the delta of the widths of the ribs 342, 344 may be smaller as compared to configurations in which a second thermal sensor is disposed on the first rib 342 along with the drop ejection circuitry 354. In various implementations, this reduced delta may allow a printhead die to be narrower than would otherwise be possible. Moreover, in some implementations, the second rib 344 may be configured with a minimum width so as to endow the second rib 344 with adequate mechanical strength to withstand handling and operation of the apparatus 300. In these implementations, disposing the thermal sensor 356 on the second rib 344 may allow the minimum width to be efficiently used for thermal sensing as opposed to disposing the thermal sensor 356 on the first rib 342, which would increase the overall width of the apparatus 300 as compared to the described implementations.

In various implementations, the thermal sensor 356 may comprise a thermal sense resistor or other suitable thermal sensing device. For various implementations in which the thermal sensor 356 comprises a thermal sense resistor, the thermal sensor 356 may comprise a serpentine-shaped structure having a plurality of elongate portions 358 extending along a length of the second rib 344 and a plurality of transition regions 360 extending along a width of the second rib 344 near the top and the bottom of the elongate portions 358, as illustrated. In various implementations, current may enter the thermal sensor 356 through one of the terminals 362, 364 and exit through the other one of the terminals 362, 364. Numerous other configurations may be possible within the scope of the present disclosure.

Figure 4:
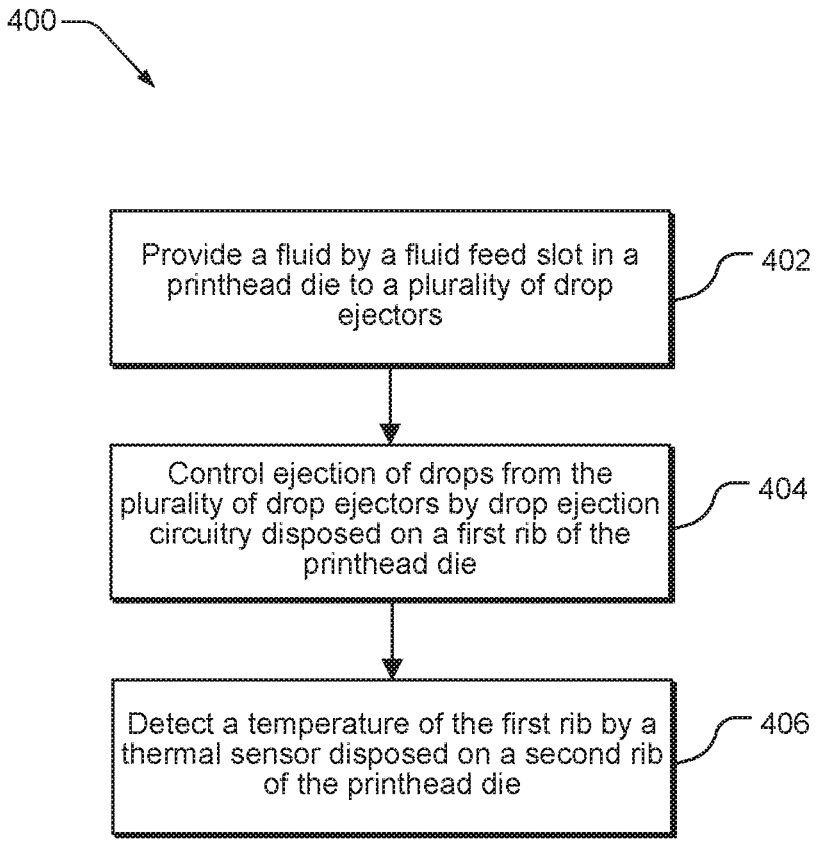
FIG. 4 is a flow diagram of an example method for single-side thermal sensing by a printhead.

FIG. 4 is a flowchart of an example method 400 related to operation of a fluid ejection apparatus with single-side thermal sensing, in accordance with various implementations described herein. The method 400 may be associated with the various implementations described herein with reference to FIGS. 1, 2, 3*a*, and 3*b*, and details of the operations shown in the method 400 may be found in the related discussion of such implementations. The operations of the method 400 may be embodied as programming instructions stored on a computer/processor-readable medium, such as memory 128 described herein with reference to FIG. 1. In an implementation, the operations of the method 400 may be achieved by the reading and execution of such programming instructions by a processor, such as processor 126 described herein with reference to FIG. 1. It is noted that various operations discussed and/or illustrated may be generally referred to as multiple discrete operations in turn to help in understanding various implementations. The order of description should not be construed to imply that these operations are order dependent, unless explicitly stated. Moreover, some implementations may include more or fewer operations than may be described.

Turning now to FIG. 4, the method 400 may begin or proceed with providing a fluid by a fluid feed slot in a printhead die to a plurality of drop ejectors, at block 402. The method 400 may proceed to block 404 with controlling ejection of fluid drops from the plurality of drop ejectors by drop ejection circuitry disposed on a first rib of the printhead die at a first side of the fluid feed slot. In various implementations, the drop ejection circuitry may control one or more actuators, such as resistive elements, heating elements, or piezoelectric elements, for example, proximate to firing chambers and drop ejectors to cause fluid to be ejected through a corresponding one of the drop ejectors. In various implementations, providing the fluid to the plurality of drop ejectors may comprise providing the fluid to a first plurality of drop ejectors over a first rib at a first side of the fluid feed slot of the printhead die and a second plurality of drop ejectors over a second rib at a second side, opposite the first side, of the fluid feed slot.

The method 400 may continue to block 406 with detecting the temperature of the first rib by a thermal sensor disposed on a second rib of the printhead die at a second side, opposite the first side, of the fluid feed slot. In various implementations, the thermal sensor comprises a thermal sense resistor. In various implementations, detecting the temperature of the first rib may comprise detecting a temperature of the second rib by the thermal sensor and determining the temperature of the first rib based at least in part on the temperature of the second rib. In various implementations, controlling ejection of drops may comprise controlling ejection of drops from the first plurality of drop ejectors based at least in part on the temperature of the second rib. For example, ejection of drops may be halted or printing may be modulated in the event the printhead die is overheated. In various implementations, the fluid ejection apparatus may heat a printhead assembly that is below a desired operating temperature.

Although certain implementations have been illustrated and described herein, it will be appreciated by those of ordinary skill in the art that a wide variety of alternate and/or equivalent implementations calculated to achieve the same purposes may be substituted for the implementations shown and described without departing from the scope of this disclosure. Those with skill in the art will readily appreciate that implementations may be implemented in a wide variety of ways. This application is intended to cover any adaptations or variations of the implementations discussed herein. It is manifestly intended, therefore, that implementations be limited only by the claims and the equivalents thereof.

What is claimed is:

1. A fluid ejection printhead comprising:

a fluid feed structure to supply a fluid to a plurality of drop ejectors;

a first rib at a first side of the fluid feed structure and supporting drop ejection circuitry to control ejection of drops of the fluid from the plurality of drop ejectors; and a second rib at a second side, opposite the first side, of the fluid feed structure and supporting a thermal sensor to facilitate determination of a temperature of the first rib;

wherein the fluid feed structure is disposed between the first rib and the second rib; and wherein the thermal sensor comprises a thermal sense resistor.

2. The fluid ejection printhead of claim 1, wherein the fluid feed structure comprises a fluid feed slot.

3. The fluid ejection printhead of claim 1, wherein the first rib is wider than the second rib.

4. The fluid ejection printhead of claim 1, wherein the plurality of drop ejectors comprise a first plurality of drop ejectors over the first rib and a second plurality of drop ejectors over the second rib.

5. The fluid ejection printhead of claim 4, wherein the drop ejection circuitry is to control ejection of drops from the first plurality of drop ejectors and the second plurality of drop ejectors.

6. The fluid ejection printhead of claim 1, wherein the plurality of drop ejectors comprises a plurality of columns of the drop ejectors, and wherein a first column of the drop ejectors is disposed over the first rib and a second column of drop ejectors is disposed over the second rib.

7. The fluid ejection printhead of claim 1, wherein the thermal sense resistor comprises a serpentine-shaped structure having a plurality of elongate portions extending along a length of the second rib and a plurality of transition regions extending along a width of the second rib.

8. The fluid ejection printhead of claim 1, wherein the first rib is devoid of thermal sensors.

9. The fluid ejection printhead of claim 1, further comprising a substrate including the first rib, wherein the fluid feed slot is off centered in the substrate.

10. A fluid ejection printhead comprising:

a substrate in which a printhead die is embedded; and a fluid feed slot to supply fluid to a plurality of drop ejectors of the printhead die the printhead die further comprising:

a first rib at a first side of the fluid feed slot and supporting drop ejection circuitry to control ejection of drops of the fluid from the plurality of drop ejectors; and a second rib at a second side, opposite the first side, of the fluid feed slot and supporting a thermal sensor to facilitate determination of a temperature of the first rib;

wherein the thermal sensor comprises a thermal sense resistor; and wherein the plurality of drop ejectors comprises a plurality of columns of the drop ejectors, and wherein a first column of the drop ejectors is disposed over the first rib and a second column of drop ejectors is disposed over the second rib.

11. The fluid ejection printhead of claim 10, wherein the first rib is devoid of thermal sensors.

12. The fluid ejection printhead of claim 10, wherein the first rib is wider than the second rib.

13. The fluid ejection printhead of claim 10, wherein the drop ejection circuitry is to control ejection of drops from the first column of drop ejectors and the second column of drop ejectors.

14. The fluid ejection printhead of claim 10, wherein the thermal sensor comprises a thermal sense resistor.

15. The fluid ejection printhead of claim 14, wherein the thermal sense resistor comprises a serpentine-shaped structure having a plurality of elongate portions extending along a length of the second rib and a plurality of transition regions extending along a width of the second rib.

16. The fluid ejection printhead of claim 10, wherein the fluid feed slot is off centered in the substrate.

17. A fluid ejection printhead comprising:

a fluid feed structure to supply a fluid to a plurality of drop ejectors;

a first rib at a first side of the fluid feed structure and supporting drop ejection circuitry to control ejection of drops of the fluid from the plurality of drop ejectors; and a second rib at a second side, opposite the first side, of the fluid feed structure and supporting a thermal sensor to facilitate determination of a temperature of the first rib;

wherein the fluid feed structure is disposed between the first rib and the second rib;

wherein the thermal sensor comprises a thermal sense resistor; and wherein the first rib is devoid of thermal sensors.

18. The fluid ejection printhead of claim 17, wherein the first rib is wider than the second rib.

19. The fluid ejection printhead of claim 17, wherein the plurality of drop ejectors comprise a first plurality of drop ejectors over the first rib and a second plurality of drop ejectors over the second rib.

20. The fluid ejection printhead of claim 19, wherein the drop ejection circuitry is to control ejection of drops from the first plurality of drop ejectors and the second plurality of drop ejectors.

* * * * *